US007789810B2

(12) United States Patent
Le

(10) Patent No.: US 7,789,810 B2
(45) Date of Patent: Sep. 7, 2010

(54) TRAINING TOOL FOR MARTIAL ARTS

(76) Inventor: Andrew Viet Le, #404 - 3800 Quadra Street, Victoria, BC (CA) V8X 1H8

( * ) Notice: Subject to any disclaimer, the term of this patent is extended or adjusted under 35 U.S.C. 154(b) by 1 day.

(21) Appl. No.: 12/236,308

(22) Filed: Sep. 23, 2008

(65) Prior Publication Data

US 2009/0082179 A1 Mar. 26, 2009

Related U.S. Application Data

(60) Provisional application No. 60/974,635, filed on Sep. 24, 2007.

(51) Int. Cl.
*A63B 21/00* (2006.01)

(52) U.S. Cl. ..... 482/83; 482/90

(58) Field of Classification Search ..... 482/83–90; 446/100, 327; 2/18; D/361
See application file for complete search history.

(56) References Cited

U.S. PATENT DOCUMENTS 421,447 A * 2/1890 stewart ..... 2/18
3,755,820 A 9/1973 Petrusek
3,855,633 A * 12/1974 Rhee ..... 2/18
4,077,624 A 3/1978 Feasor
4,088,315 A 5/1978 Schemmel
4,991,231 A * 2/1991 Swift ..... 2/18
5,281,191 A 1/1994 De Sousa
5,498,189 A * 3/1996 Townsend ..... 446/100
5,971,398 A 10/1999 Broussard et al.
5,975,980 A * 11/1999 Whiteneck ..... 446/327
6,110,079 A 8/2000 Luedke et al.
6,178,553 B1 * 1/2001 Bolton ..... 2/18
6,971,943 B1 * 12/2005 Schulze ..... 446/327
7,052,443 B2 5/2006 Phillips
7,306,464 B2 * 12/2007 Long et al. ..... 434/247

* cited by examiner

*Primary Examiner*—Jerome Donnelly

(57) ABSTRACT

A martial-arts training tool and more particularly a hand-held strike target configured to resemble a human head. The training tool including: a hand grip located within the strike target and spanning an inner cavity therein; a support collar attached to the strike target and configured to splint and pad the user's wrist and forearm; a height line attached to the strike target for assisting in maintaining the strike target at a desired height; and an external stabilizing grip located in the vicinity of the top of the strike target and configured to permit the user to stabilize the training tool with the user's other hand.

17 Claims, 4 Drawing Sheets

TRAINING TOOL FOR MARTIAL ARTS

This application claims the benefit of U.S. Provisional Patent Application No. 60/974,635, filed 24 Sep. 2007.

FIELD OF THE INVENTION

This invention relates to a martial-arts training tool and more particularly to a hand-held strike target configured to resemble a human head.

BACKGROUND OF THE INVENTION

Martial-arts training tools are well known.

U.S. Pat. No. 4,077,624; STRIKING DEVICE FOR TRAINING IN MARTIAL ARTS; Feasor; issued 7 Mar. 1978, discloses a striking device having target elements suspended by a cord and pivoting rod-mounted response elements.

U.S. Pat. No. 5,281,191; STRIKING DUMMY AS PUNCHING BAG ATTACHMENT; De Sousa; issued 25 Jan. 1994, discloses a life-like training dummy as an attachment to a punching bag.

U.S. Pat. No. 4,088,315; DEVICE FOR SELF DEFENSE TRAINING; Schemmel; issued 9 May 1978, discloses a life-like articulated training dummy supported in an upright position on a post and having a plurality of separate pressure sensors disposed at various target locations on the dummy.

U.S. Pat. No. 4,991,231; KARATE TARGET PAD; Swift; issued 12 Feb. 1991, discloses a karate target pad, preferably shaped to resemble a human head, which in use is worn on the user's hand, wherein the user's hand is disposed within a mitten-shaped internal void configured to receive a hand in an open, but slightly flexed, position, with the rough plane of the open hand generally aligned with the plane of symmetry of the "head".

U.S. Pat. No. 7,052,443; MARTIAL ARTS PRACTICE DEVICE; Phillips; issued 30 May 2006, discloses a kicking exercise device having a frame adapted to be held by a user (preferably with two hands) and a head/target portion mounted to the frame with a coil spring.

U.S. Pat. No. 5,971,398; THREE DIMENSIONAL TRAINING MANNEQUIN WITH LIFELIKE REACTION AND FEEL FOR SPARRING AND SELF DEFENSE TRAINING; Broussard et al.; issued 26 Oct. 1999, discloses a life-size training mannequin comprising a torso and head having a resilient outer skin filled with flexible interior foam, and preferably mounted on a telescoping pole projecting from a weighted base.

U.S. Pat. No. 6,110,079; KICK-BOXING EXERCISE DEVICE; Luedke et al.; issued 29 Aug. 2000, discloses a kick-boxing exercise device having a weighted base and a target preferably in the general shape of a human torso and head, and having a plurality of target areas with LED's and associated sensors, whereby punch and kick sequences may be indicated by illuminating different LEDs sequentially and the user's proficiency may be evaluated through the pressure information obtained from the sensors.

U.S. Pat. No. 3,755,820; INFLATABLE BOXING GLOVE OR PILLOW; Petrusek; issued 4 Sep. 1973, discloses an air-inflated boxing glove or pillow.

SUMMARY OF THE INVENTION

In one aspect, the martial arts training tool of the present invention provides a strike target configured to resemble a human head wherein the strike target may be used on either the left or right hand, and the means by which the user holds the strike target permits the target to be held in a preferred position (away from the user's body and in front of the user), while minimizing the risk of injury to the user.

In another aspect, the martial arts training tool provides a strike target having means for maintaining the target at a desired height.

In another aspect, the martial arts training tool provides a strike target having one or more target points at locations corresponding to locations on a face and head where it is desirable to strike relatively precisely.

In another aspect, the martial arts training tool provides means for using the strike target with both hands while permitting the target to be held in a preferred position (away from the user's body and in front of the user), while minimizing the risk of injury to the user.

In another aspect, there is provided a martial arts training tool for use by a user to assist another person to practice strikes suitable for striking an opponent's head, the training tool consisting of: a strike target configured to resemble a human head and having contours generally conforming to facial features at the front of the strike target; an inner cavity within the strike target, the inner cavity having an opening at the back of the strike target and configured to receive a hand of the user via the opening; a hand grip located within and spanning the inner cavity, the hand grip configured to permit the fingers and thumb of the hand to curl around the hand grip in an opposed manner, so as to form a fist about the hand grip; and a support collar attached to the strike target in the vicinity of the opening, the support collar configured such that the diameter of the support collar may be reduced to tighten the support collar about the wrist and forearm adjoining the hand.

The martial arts training tool may be generally symmetrical and the hand grip may extend generally normal to the plane of symmetry.

The support collar may be substantially rigid such that when tightened about the wrist and forearm the support collar impedes flexion of the wrist and forearm.

The martial arts training tool may include an external stabilizing grip configured to permit the user to stabilize the training tool with the user's other hand. The stabilizing grip may include an indentation in the surface of the training tool for receiving the fingers of the user's other hand. The indentation may be located in the vicinity of the top of the training tool. The stabilizing grip may include a depression configured to receive the palm of the other hand when the fingers of the other hand are in the indentation.

The martial arts training tool may include a height line attached to the strike target for assisting in maintaining the strike target at a desired height. The height line may be a tape marked with distance increments. A weight may be attached to the distal end of the height line to cause the height line to be relatively straight during use. The height line may be reversibly retractable into the strike target the height line wherein the height line may be partially retracted for setting a desired length of height line or the height line may be fully retracted. The height line may be reversibly detachable from the strike target.

The martial arts training tool may include one or more strike points on the surface of the strike target, of a colour different from the colour of the strike target. The strike points may be located at locations on the strike target corresponding to selected features of a head at which it is desirable to land blows during martial arts bouts. The strike points may be located at features on the strike target generally corresponding to: a nose, upper cheeks, eyes, chin and jaw sides.

The support collar may include one or more straps for releasably securing the support collar in a tightened condition.

The strike target may be configured to have features easily recognizable as corresponding to those of a human head, being ears, eyes, a nose, a mouth and a chin.

In another aspect, there is provided a martial arts training tool for use by a user to assist another person to practice strikes suitable for striking an opponent's head, the training tool consisting of: a strike target configured to resemble a human head and having contours generally conforming to facial features at the front of the strike target; a hand grip located within and spanning the inner cavity, the hand grip configured to permit the fingers and thumb of a hand to curl around the hand grip in an opposed manner, so as to form a fist about the hand grip; a support collar attached to the strike target in the vicinity of the opening, the support collar configured such that the diameter of the support collar may be reduced to tighten the support collar about a user's forearm; a height line attached to the strike target for assisting in maintaining the strike target at a desired height; one or more strike points on the surface of the strike target, wherein the strike points are a colour different from the colour of the strike target; and an external stabilizing grip located in the vicinity of the top of the strike target and configured to permit the user to stabilize the training tool with the user's other hand.

As compared to known martial arts training tools comprising hand-held strike targets, the martial arts training tool of the present invention tends to provided greater protection from injury, in that: the user's hands are not extended so as to expose the fingers to longitudinal compressive forces (with possible resulting trauma to a digit, commonly referred to as "a jammed finger"); the user's wrist and forearm is splinted by the supporting collar, thus impeding flexion of the joint and limb; and the general configuration of the training tool enables the user to position the training tool in front of the user and away from the user's body (which reduces the possibility of injury from misdirected or "wild" blows). It is also generally preferable for the user to hold the target pad generally in front of himself or herself to better observe, and thus instruct, the person being trained.

DETAILED DESCRIPTION WITH REFERENCE TO THE DRAWINGS

Figure 1:
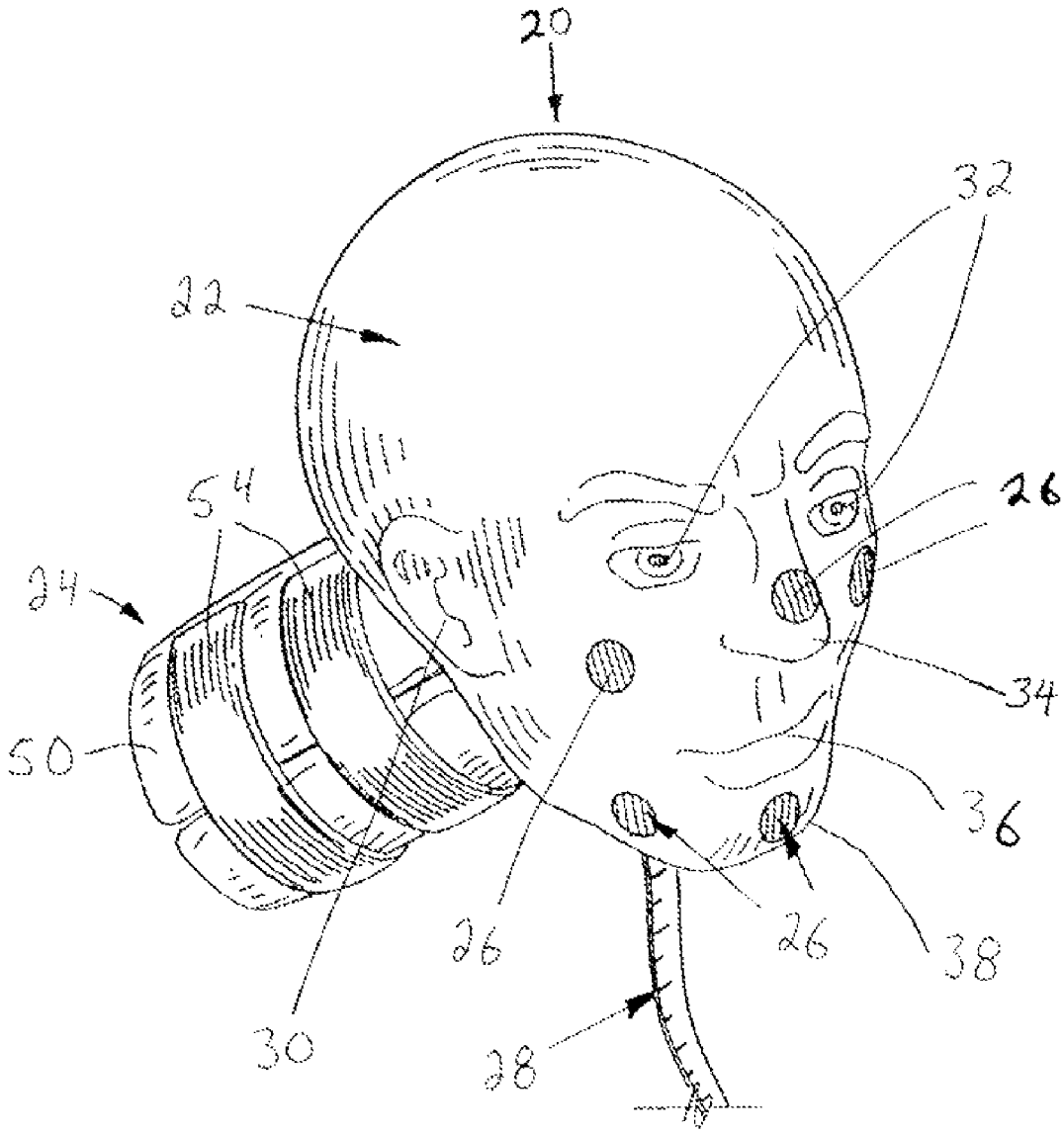
FIG. 1 is a perspective view of a one-hand embodiment of the present martial arts training tool.
Figure 2:
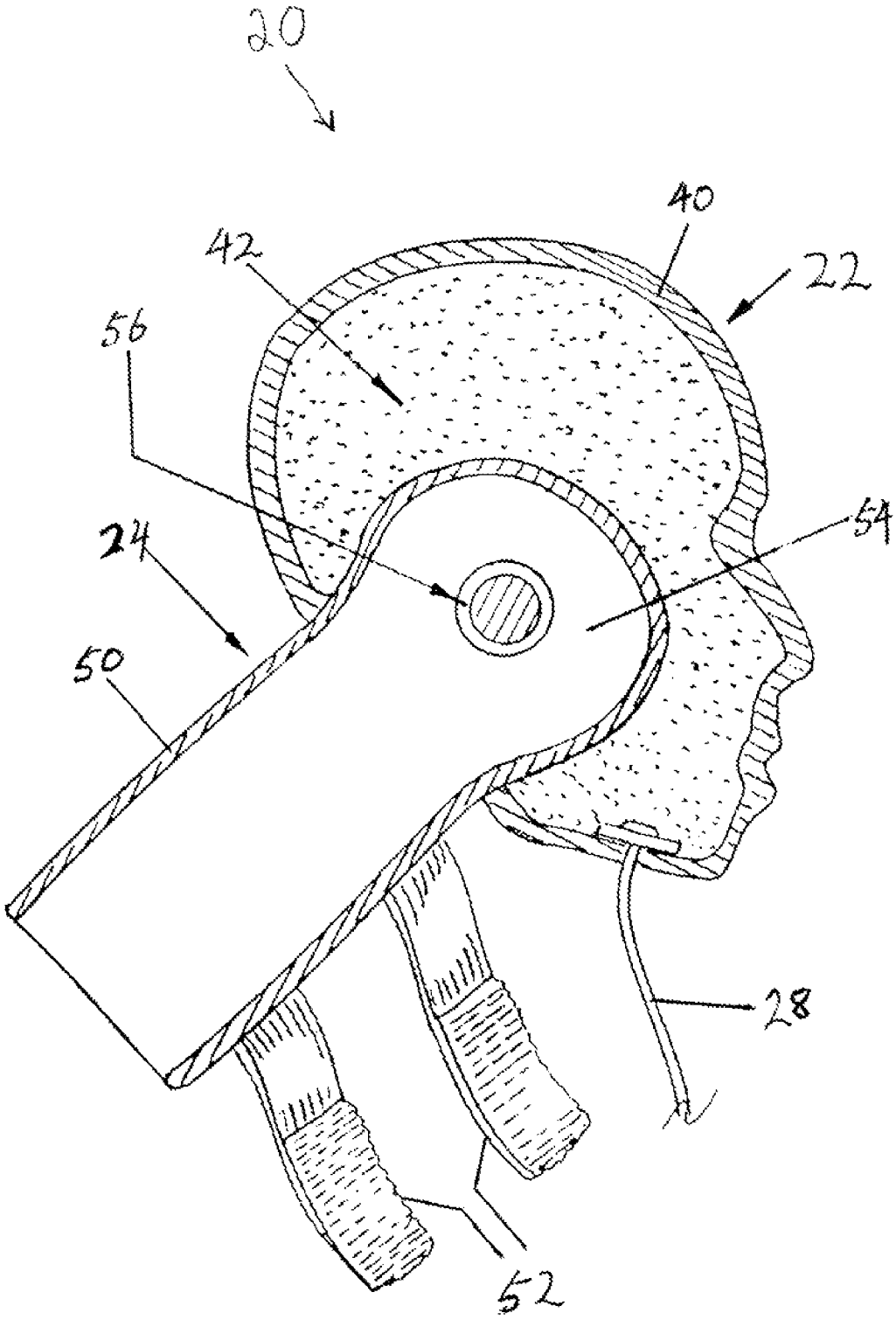
FIG. 2 is a side sectional view of the training tool shown in FIG. 1.

As shown in FIGS. 1 and 2, a one-hand training tool 20 comprises a strike target 22 configured to conform to the general shape of a human head, a support collar 24 projecting from the back of the strike target 22, a plurality of strike points 26 arrayed on the surface of the strike target 22 and a height line 28 connected to the bottom of the strike target 22.

Preferably, the strike target 22 is configured to have contours generally conforming to selected features of a head at which it is desirable to land blows during martial arts competitions, i.e.: a protuberance corresponding to a nose and located roughly in the center of front of the strike target; contours corresponding to cheek bones located on either side of the nose protuberance; and, in the vicinity of the bottom of the strike target, contours generally corresponding to a chin and the sides of a jaw.

More preferably, as shown in FIGS. 1 and 2, the strike target 22 is configured to have features easily recognizable as corresponding to those of a human head, i.e. ears 30, eyes 32 (or at least concavities where eyes would be expected to be located), a nose 34, a mouth 36 and a chin 38.

The strike target 22 is made such that in use, striking it roughly simulates striking a human head. As shown in FIG. 2, the striking target 22 comprised a cover 40 and a cushioning filler 42. The cover 40 is sufficiently tough to withstand the expected blows to the strike target 22 without tearing. The filler 42 is sufficiently resilient to withstand the expected blows to the strike target 22 without permanently deforming. A suitable material for the filler 42 would be a resilient dense foam. Alternatively, the strike target 22 may be made from a single material having both sufficient surface toughness and resilience.

The support collar 24 includes a generally cylindrical shell 50, attached at one end to the strike target 22, and two straps 52 about the circumference of the shell 50. The shell 50 is segmented or otherwise configured such that the straps 52 may be used to tighten the shell 50 (i.e. to reduce the diameter of the bore defined by the shell 50). For ease of use, the straps 52 preferably comprise hook and loop fasteners, such as Velcro™. However, other means of securing the straps 52 or of tightening the shell 50 may also be used. The shell 50 is preferably made from a fairly rigid lightweight material; many different plastic materials would be suitable for the shell 50. The shell 50 is preferably lined with a suitable cushioning material (not shown).

As shown in FIG. 2, the support collar 24 provides hand access to an inner cavity 54 having a hand grip 56 running normal (i.e. at 90°) to the plane of symmetry of the strike target 22 (i.e. essentially in the direction from one ear 30 to the other ear 30) within the inner cavity 54. The hand grip 56 is preferably covered with a cushioning material (not shown). Preferably, the walls of the inner cavity 54 are cushioned, either by being lined with a cushioning material or by being formed within the filler 42 (which would have some cushioning effect) without any intervening lining.

Other, though less desirable, hand-grip configurations are possible. The hand grip could be oriented at an angle other than 90° to the plane of symmetry of the strike target 22 so as to better accommodate either a right or left hand, but this would result in the training tool 20 only being comfortably useable with one or the other hand. Alternatively the hand grip could be configured so that its position within the inner cavity 54, including its angle relative to the plane of symmetry of the strike target 22, could be adjusted. However, it is understood that the possible marginal gain in utility would likely not justify the added complexity and cost associated with making the hand grip adjustable.

Strike points 26 are preferably located at locations on the strike target 22 corresponding to selected features of a head at which it is desirable to land blows during martial arts competitions. As shown in FIG. 1, strike points 26 are located at: the nose 34; below the eyes 32 at each side of the nose 34 (i.e. at locations corresponding to the upper cheeks); at the chin 38; and on each side of the chin 38 (i.e. at locations corresponding to the sides of the jaw). In the embodiment shown in the drawings, the strike points 26 are merely circles of a bright colour intended to contrast with the colour of the strike target 22 so as to be easily visible. The strike points 26 may further comprise sensors (not shown) connected to auditory and/or visual signalers (not shown) so as to give a signal when a desired strike point 26 is struck, so as to further assist a person training with the training tool 20 to improve the accuracy of his or her blows. Further, the sensors and auditory and/or visual signalers may be configured to indicate the impact force of a blow at a strike point 26, so as to assist a person training with the training tool 20 to improve both the strength and accuracy of his or her blows.

The height line 28 is used to maintain the strike target 22 at a desired height above the ground, perhaps in preparation for a bout with an opponent of a known height. A variety of different configurations will work for the height line. As shown in FIG. 1, the height line 28 may be a tape marked with distance increments. As shown in FIG. 2, the height line 28 may be a cord, with or without distance increments. Preferably, there is a weight (not shown) at the distal end of the height line 28 to keep the height line 28 relatively straight in use. The strike target 22 may contain a lockable spool or other means (not shown) for retracting the height line 28 partially into the strike target 22 for setting the desired length of height line 28 (and thus the height of the strike target 22), or for retracting the height line wholly into the strike target 22 if the height line 28 is not required for a particular use. Alternatively, a lockable spool or other retraction means (not shown) may be located at the distal end of the height line 28 for adjusting the length of the height line 28, in which case the lockable spool or other retraction means would also function as a weight to keep the height line 28 relatively straight in use. In the case of a retraction means located at the distal end of the height line 28, the height line 22 is preferably detachable from the strike target 22 so that the height line 28 may be removed if the height line 28 is not required for a particular use and reattached when it is once again required.

Figure 4:
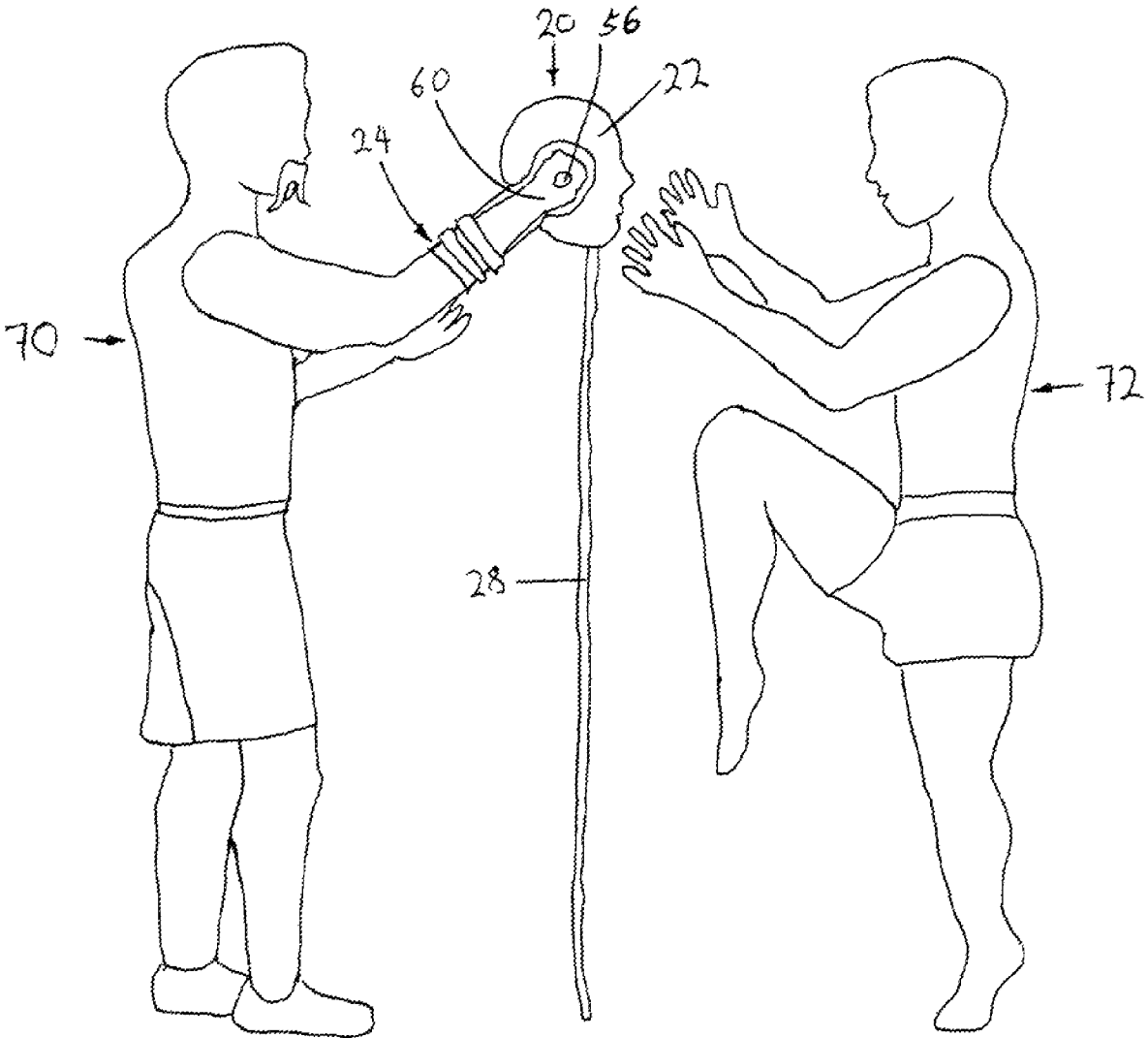
FIG. 4 is a side elevation partially sectional view of the training tool shown in FIG. 1, shown in use in the practicing of a knee strike.

As shown in FIG. 4, in use, the user's hand 60 is inserted into the inner cavity 54 via the support collar 24. The user's hand 60 grasps the hand grip 56. The straps 52 are used to tighten the shell 50 around the user's forearm.

As shown in FIG. 4, the user 70 (the person with the moustache) uses the height line 28 to hold the training tool 20 at a desired height so as to permit the person training 72 to practice strikes (an imminent knee strike is indicated in FIG. 4). In use, the support collar 24 both: essentially splints the wrist of the user 70 to reduce the likelihood of wrist strains; and acts as armour for the forearm of the user 70 to reduce injury due to direct impact of mis-aimed strikes.

Figure 3:
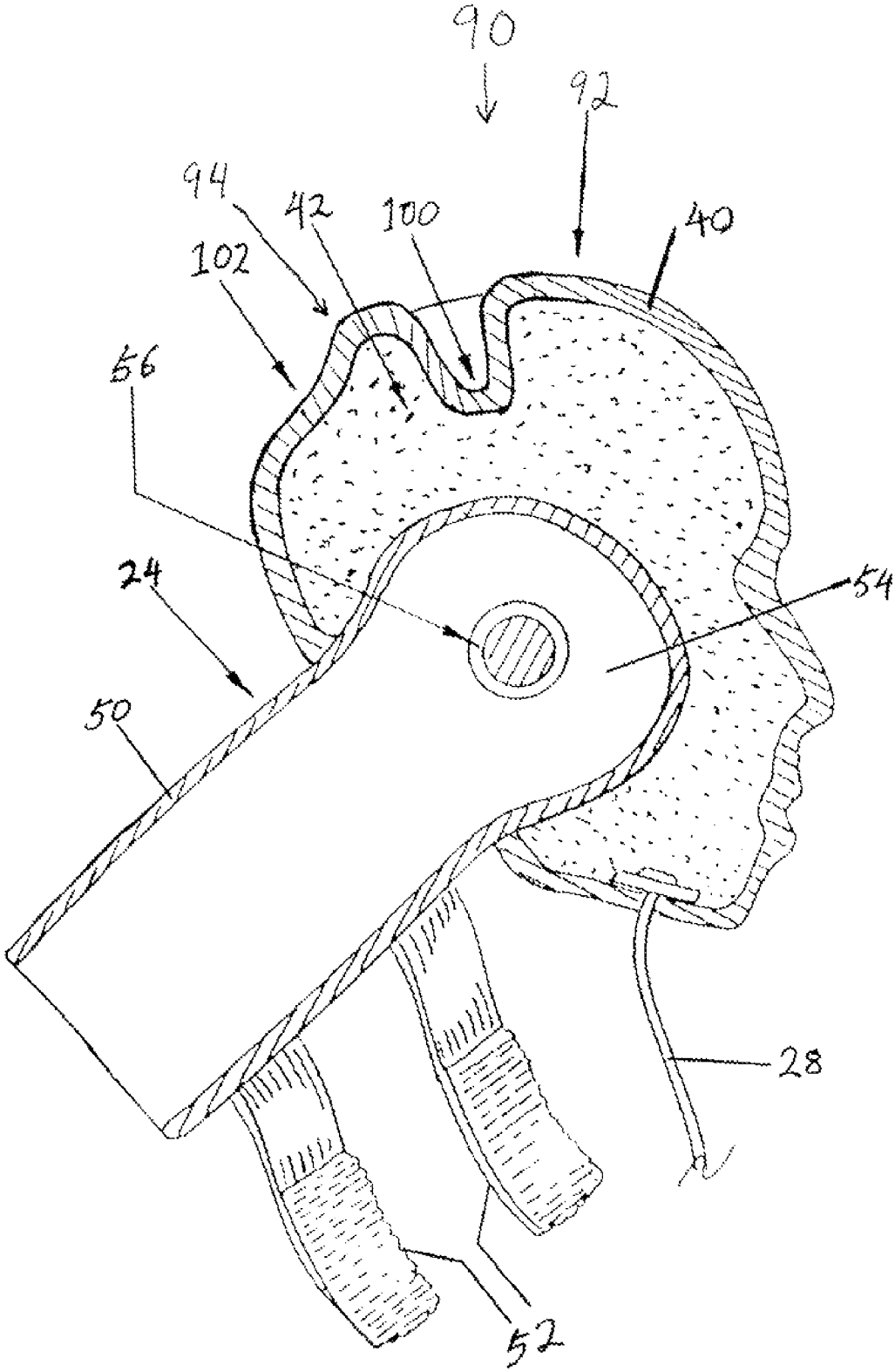
FIG. 3 is a side sectional view of a two-hand embodiment of the present martial arts training tool.

A two-hand training tool 90 is shown in FIG. 3. The two-hand training tool 90 includes an external-grip strike target 92 configured to conform to the general shape of a human head and a support collar 24 projecting from the back of the external-grip strike target 92. The external-grip strike target 92 is similar in construction to the strike target 22 and includes an inner cavity 54 and hand grip 56.

The external-grip strike target 92 has an external grip 94 located in the vicinity of the top of the external-grip strike target 92. The external grip 94 includes a forward indentation 100 configured to receive the fingers of the hand of the user not engaged with the hand grip 56 (generally referred to herein as the other hand), and a rearward depression 102 configured to receive the palm of the other hand. The indentation 100 and depression 102 are configured to be engaged by either the user's right hand or left hand. In use, the user first inserts a hand into the inner cavity 54, grasps the hand grip 56 and secures the support collar 24, before gripping the external grip 94. To use the external grip 94, the user inserts the fingers of the other hand into the indentation 100 and positions the palm of the other hand in the depression 102. During a training session, the user's grip on the external grip 94 is dynamically adjustable responsive to different training situations. If, during a training session, the person training pulls the two-hand training tool 90 away from the user, the fingers of the user's other hand may be used to resist that movement. If the person training strikes the two-hand training tool 90 so as to cause it to move towards the user, the impact of such a strike will be in part absorbed by the palm of the other hand rather than the fingers of the other hand. If the user desires to secure the engagement of the other hand with the external grip 94 so as to reduce the likelihood of the other hand being dislodged from the external grip 94, the user may do so by clenching between the fingers and palm of the other hand, the portion of the external-grip strike target 92 between the indentation 100 and the depression 102. Further, the other hand may be disengaged from or engaged with the external grip 94 as the user desires. That is, the two-hand training tool 90 may be used one-handed or two-handed.

What is claimed is:

1. A martial arts training tool for use by a user to assist another person to practice strikes suitable for striking an opponent's head, the training tool comprising:

a) a strike target configured to resemble a human head and having contours generally conforming to facial features at the front of the strike target;

b) an inner cavity within the strike target, the inner cavity having an opening at the back of the strike target and configured to receive a hand of the user via the opening;

c) a hand grip located within and spanning the inner cavity, the hand grip configured to permit the fingers and thumb of the hand to curl around the hand grip in an opposed manner, so as to form a fist about the hand grip;

d) a support collar attached to the strike target in the vicinity of the opening, the support collar configured such that the diameter of the support collar may be reduced to tighten the support collar about the wrist and forearm adjoining the hand; and e) an external stabilizing grip configured to permit the user to stabilize the training tool with the user's other hand.

2. The martial arts training tool of claim 1, wherein the martial arts training tool is generally symmetrical and the hand grip extends generally normal to the plane of symmetry.

3. The martial arts training tool of claim 1, wherein the support collar is substantially rigid such that when tightened about the wrist and forearm the support collar impedes flexion of the wrist and forearm.

4. The martial arts training tool of claim 1, wherein the stabilizing grip comprises an indentation in the surface of the training tool for receiving the fingers of the user's other hand.

5. The martial arts training tool of claim 4, wherein the indentation is located in the vicinity of the top of the training tool.

6. The martial arts training tool of claim 5, wherein the stabilizing grip further comprises a depression configured to receive the palm of the other hand when the fingers of the other hand are in the indentation.

7. The martial arts training tool of claim 1, further comprising a height line attached to the strike target for assisting in maintaining the strike target at a desired height.

8. The martial arts training tool of claim 7, wherein the height line is a tape marked with distance increments.

9. The martial arts training tool of claim 7, wherein a weight is attached to the distal end of the height line to cause the height line to be relatively straight during use.

10. The martial arts training tool of claim 7, wherein the height line is reversibly retractable into the strike target wherein the height line may be partially retracted for setting a desired length of height line or the height line may be fully retracted.

11. The martial arts training tool of claim 7, wherein the height line is reversibly detachable from the strike target.

12. The martial arts training tool of claim 1, further comprising one or more strike points on the surface of the strike target, wherein the strike points are a colour different from the colour of the strike target.

13. The martial arts training tool of claim 12, wherein the strike points are located at locations on the strike target corresponding to selected features of a head at which it is desirable to land blows during martial arts bouts.

14. The martial arts training tool of claim 12, wherein the strike points are located at features on the strike target generally corresponding to: a nose, upper cheeks, eyes, chin and jaw sides.

15. The martial arts training tool of claim 1, wherein the support collar comprises one or more straps for releasably securing the support collar in a tightened condition.

16. The martial arts training tool of claim 1, wherein the strike target is configured to have features easily recognizable as corresponding to those of a human head, being ears, eyes, a nose, a mouth and a chin.

17. A martial arts training tool for use by a user to assist another person to practice strikes suitable for striking an opponent's head, the training tool comprising:

a) a strike target configured to resemble a human head and having contours generally conforming to facial features at the front of the strike target;

c) a hand grip located within and spanning the inner cavity, the hand grip configured to permit the fingers and thumb of a hand to curl around the hand grip in an opposed manner, so as to form a fist about the hand grip;

d) a support collar attached to the strike target in the vicinity of the opening, the support collar configured such that the diameter of the support collar may be reduced to tighten the support collar about a user's forearm;

e) a height line attached to the strike target for assisting in maintaining the strike target at a desired height;

f) one or more strike points on the surface of the strike target, wherein the strike points are a colour different from the colour of the strike target; and g) an external stabilizing grip located in the vicinity of the top of the strike target and configured to permit the user to stabilize the training tool with the user's other hand.

* * * * *